US008204408B2

(12) United States Patent
Takayama

(10) Patent No.: US 8,204,408 B2
(45) Date of Patent: Jun. 19, 2012

(54) DEVELOPMENT APPARATUS AND IMAGE FORMING APPARATUS

(75) Inventor: Takeshi Takayama, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 1109 days.

(21) Appl. No.: 12/040,265

(22) Filed: Feb. 29, 2008

(65) Prior Publication Data

US 2008/0219706 A1 Sep. 11, 2008

(30) Foreign Application Priority Data

Mar. 6, 2007 (JP) ..... 2007-055920

(51) Int. Cl.
*G03G 15/08* (2006.01)

(52) U.S. Cl. ..... 399/254; 399/256; 399/263

(58) Field of Classification Search ..... 399/254
See application file for complete search history.

(56) References Cited

U.S. PATENT DOCUMENTS

| | | | | |
|---|---|---|---|---|
| 6,055,405 | A * | 4/2000 | Knott et al. | 399/358 |
| 6,266,511 | B1 * | 7/2001 | Murakami et al. | 399/358 |
| 2006/0222408 | A1 * | 10/2006 | Suenami et al. | 399/254 |

FOREIGN PATENT DOCUMENTS

| | | |
|---|---|---|
| JP | 6-167880 | 6/1994 |
| JP | 2006-235255 | 9/2006 |
| JP | 2006-301604 | 11/2006 |

* cited by examiner

*Primary Examiner* — David Gray
*Assistant Examiner* — Andrew Do
(74) *Attorney, Agent, or Firm* — Nixon & Vanderhye P.C.

(57) ABSTRACT

In one embodiment, in a development apparatus in which at least a first screw conveyor has been provided in a case, a developer affixing prevention member that prevents a developer from affixing to the first screw conveyor is disposed in the vicinity of a toner resupply port provided in the case. More specifically, the developer affixing prevention member is formed with a torsion coil spring formed from the wire rod whose middle has been wound in a coil-like shape, and in a state with the wound portion of this torsion coil spring supported by a support plate of the case, one arm portion is fixed to the support plate, and another arm portion is extended so as to contact a fin and a rotating shaft of the first screw conveyor.

12 Claims, 9 Drawing Sheets

DEVELOPMENT APPARATUS AND IMAGE FORMING APPARATUS

CROSS-REFERENCE TO RELATED APPLICATION

This application claims priority under 35 U.S.C. §119(a) on Japanese Patent Application No. 2007-055920 filed in Japan on Mar. 6, 2007, the entire contents of which are herein incorporated by reference.

BACKGROUND OF THE TECHNOLOGY

1. Field of the Technology

The present technology relates to development apparatuses used in image forming apparatuses such as copiers, printers, digital multifunction devices, and the like that form images using a developer, and more specifically relates to development apparatuses that use a two-component developer.

2. Related Art

In a conventional electrophotographic image forming apparatus, after uniformly charging a photosensitive body with a charging apparatus, an electrostatic latent image is formed on this photosensitive body with, for example, a laser beam, and this electrostatic latent image is made visible as a toner image by the development apparatus. After the toner image is transferred to recording paper, the toner image is affixed to the recording paper by a fixing apparatus.

Inside the development apparatus, a developer that includes toner is circulated and conveyed, and toner is appropriately resupplied from a toner cartridge. Included in this resupplied toner is a wax component that melts easily with heat, in order to insure low temperature fixing properties.

In a conventional development apparatus, the conveying speed at which developer is conveyed is slow, and there is a comparatively small amount of wax in the toner, so the toner only slightly condenses and affixes to a conveying member that conveys the developer. Therefore, conventionally nothing has been done to prevent this condensation and affixing.

However, recently, image forming apparatuses have appeared that perform print processing at high speed, and in order to be compatible with these high speed processing devices, wax with a low melting point is used, and there is high tendency for the amount of added wax to be increased. Also, in the case of a high speed processing device, because circulating conveying of developer in the development apparatus is also fast, when wax with a low melting point is used, and the amount of wax blended is increased, there is the problem that toner is more easily condensed due to heat produced during circulating conveying in the development apparatus. Also, when temperature is high, there is the problem that toner affixes to a specific portion of the conveying member. In particular, the vicinity of a toner resupply port is normally in state filled with toner resupplied from the toner cartridge, so frictional heat among developer, and frictional heat between developer and the conveying member, is high, and this is a circumstance in which toner condensation and toner affixing easily occur.

Following is a specific description of toner condensation and toner affixing in a conventional development apparatus, with reference to FIGS. 8 and 9. FIGS. 8 and 9 show a conventional development apparatus, with FIG. 8 being a plan view showing a state in which an upper lid has been provided, and FIG. 9 being a plan view showing a state in which the upper lid is omitted.

As shown in FIG. 8, on the upper face of a case 310 of a development apparatus 300, a toner resupply port 311 is provided in order to resupply toner from a toner cartridge (not shown) in which toner is accumulated.

Also, as shown in FIG. 9, inside the development apparatus 300, a first developer conveying path 301 one end of which faces the toner resupply port 311, and a second developer conveying path 302, are provided in rows, and the developer conveying paths 301 and 302 are partitioned by a partition wall 303. Between both ends of the partition wall 303 and the case 310, respective open portions 304 and 305 are provided, and thus the developer conveying paths 301 and 302 have a structure so as to be in communication with each other via the open portions 304 and 305.

Also, a first screw conveyor 306 is disposed in the first developer conveying path 301, a second screw conveyor 307 is disposed in the second developer conveying path 302, and with rotation of the screw conveyors 306 and 307, developer inside the case 310 is circulated and conveyed between the first developer conveying path 301 and the second developer conveying path 302.

More specifically, toner that has been resupplied from the toner resupply port 311 is conveyed in the first developer conveying path 301 by the first screw conveyor 306 while mixing with magnetic carrier in the rightward direction in FIG. 8, developer in which toner and the magnetic carrier have been mixed is conveyed to the second developer conveying path 302 via the open portion 305 on the right end, then conveyed in the second developer conveying path 302 by the second screw conveyor 307 in the leftward direction in FIG. 8, and again conveyed to the first developer conveying path 301 via the open portion 304 on the left end. The developer is circulated by following this sort of conveying path.

Here, the toner that has been resupplied from the toner resupply port 311 to the first developer conveying path 301 merges with the developer that has been conveyed from the second developer conveying path 302 via the open portion 304 immediately behind the position of that toner resupply port 311, and this merging portion is in a location where accumulation easily occurs. Therefore, particularly in the vicinity of the toner resupply port 311 on the front side of the merging portion, toner easily accumulates, and as a result, toner easily condenses on the first screw conveyor 306.

When toner condensation on the first screw conveyor 306 occurs, pressure concentrates on that portion, and if toner condensation continues, a toner deposit 309 will occur on the first screw conveyor 306. When a toner deposit 309 occurs, the actual conveying performance of the first screw conveyor 306 decreases. Thus, the problem occurs that the toner deposit becomes still larger, resupplied toner spills out from the toner resupply port 311, and rotation of the first screw conveyor 306 stops.

Such a toner affixing problem can be solved by increasing the size of the image forming apparatus itself, or by using a cooling apparatus, but market demands for reduced size of the image forming apparatus are strong, and providing a cooling apparatus results in increased cost, so addressing the toner affixing problem in these ways is difficult.

Consequently, as a means of eliminating such toner affixing, a toner resupply apparatus has been disclosed in which toner condensation is prevented with a coil spring (for example, see JP H6-167880A (referred to below as Patent Document 1)).

In the toner resupply apparatus disclosed in Patent Document 1, as shown in FIG. 8(*a*) of Patent Document 1, a protrusion (81), which is fixed at one end to a side plate (47) of a toner hopper unit (40Y) and is inserted into a coil spring (82), is provided between an agitator (44) and a toner screw conveyor (42), and is held in a state with a bottom end (821)

of the coil spring (82) in contact with a conveying blade (422) of the toner screw conveyor (42). In this state, when the toner screw conveyor (42) starts to rotate, the coil spring (82) is compressed by a rotating action of the conveying blade (422), and when compressed a certain amount, thereafter the coil spring (82) travels over the conveying blade (422) and is restored to an initial shape due to tensile force of the coil spring (82). Because the coil spring (82) bursts when being restored, a toner condensation (73) is broken up ([0032]).

However, in the toner resupply apparatus of above Patent Document 1, the coil spring (82) is required to travel over the conveying blade (422) when being restored, so it is necessary to use a large coil spring in order to reliably allow the spring to be restored. Therefore, there is the problem that the apparatus cannot be made compact. Also, the coil spring (82) is merely inserted into the protruding portion (81) and is in a dangling state, and not fixed, so due to its own weight the coil spring (82) is in contact with the rotating shaft of the toner screw conveyor (42). Accordingly, there is a possibility that the coil spring (82) as a whole will be pushed up along the slope of the face of the conveying blade (422), and in this case, there is the problem that the coil spring (82) is restored to the original state before being adequately compressed, a sufficient bursting effect is not obtained, and it may not be possible to reliably break up the toner condensation.

SUMMARY OF THE TECHNOLOGY

It is an object of the present technology to provide a development apparatus that, without interfering with size reduction of an apparatus, is capable of reliably preventing the occurrence of developer condensation (toner condensation) or developer affixing (toner affixing) with a very simple configuration, and an image forming apparatus provided with this development apparatus.

The present technology provides a development apparatus that includes, inside a development case, a developer bearing member (development roller) that supplies developer including at least toner to a latent image bearing member (photosensitive drum); a developer conveying member that conveys the developer towards the developer bearing member; and a developer affixing prevention member that prevents the developer from affixing to the developer conveying member.

The developer affixing prevention member may be disposed in the vicinity of a toner resupply port provided in the development case in order to resupply toner stored in a toner storage container (toner cartridge) into the development case.

Described more specifically, the developer conveying member, for example, may be a screw conveyor configured from a rotating shaft and a fin spirally formed on the outer circumferential portion of the rotating shaft. Also, the developer affixing prevention member, for example, may be configured from an elastic member having a fixed end and a free end, with the free end side of this elastic member disposed so as to contact the fin or contact the fin and the rotating shaft.

Here, a configuration may be adopted in which the developer affixing prevention member, for example, is formed with a torsion coil spring formed from the wire rod whose middle is wound in a coil-like shape, in which in a state with the winding portion of the torsion coil spring supported by the development case, one end is fixed to the development case, and the other end is the free end that contacts the fin of the screw conveyor or contacts the fin and the rotating shaft. Also, a configuration may be adopted in which the developer affixing prevention member, for example, is formed with a plate spring having strip form, one end of the plate spring is fixed to the development case, and the other end is the free end that contacts the fin of the screw conveyor or contacts the fin and the rotating shaft.

By adopting this sort of shape and structure, the free end of a torsion coil spring or a plate spring, due to rotation (virtual spiral rotation) of the fin with rotation of the screw conveyor, is pressed into the fin, and moves so as to be pushed and bent to the downstream side in the developer conveying direction. At this time, when the middle of the free end contacts the rotating shaft, by moving along the surface of the rotating axis, the free end acts so as to scrape away developer that is affixed to the surface of the rotating shaft. Also, the free end moves so as to largely depict an arc toward the downstream side of the developer conveying direction, and thus acts so as to scrape away developer. When the free end side is adequately elastically deformed and travels over the fin, the shape of the torsion coil spring or the plate spring is instantly restored by that elastic force, the free end instantly moves to the upstream side in the developer conveying direction, and again contacts the upstream side fin. Due to the instant movement of the free end at this time to the upstream side in the developer conveying direction, the free end acts such that the developer is flicked away, i.e. such that developer is broken up (churned). Thus, even if developer condensation begins, it is possible to instantly break up that developer condensation, and as a result it is possible to reliably prevent progression to developer affixing.

In the above configuration, it is assumed that the free end travels over the fin, but it is not absolutely necessary to elastically deform the free end until it travels over the fin. For example, a configuration may be adopted in which a cut-out portion is formed in a portion of the fin of the screw conveyor at a position faced by the free end of the torsion coil spring or the plate spring. This cut-out portion preferably has a depth that reaches the rotating shaft. Thus, before the free end of the torsion coil spring or the plate spring that has been elastically deformed with rotation (virtual spiral rotation) of the fin due to rotation of the screw conveyor travels over the fin, the free end is elastically returned to its original shape via the cut-out portion. In this case, the amount of deformation of the torsion coil spring or the plate spring is less than when traveling over the fin, but with respect to flicking away and breaking up developer, an adequate effect is obtained with this amount of deformation. Also, by providing a cut-out portion, it is possible to prevent unreasonable (excess) deformation of the torsion coil spring or the plate spring, so it is possible to also improve permanence of components themselves.

Also, in the above configuration, the developer affixing prevention member is formed from a non-magnetic member. By forming the developer affixing prevention member from a non-magnetic member, it is possible to prevent developer condensation without adversely affecting developer conveying. Also, the developer affixing prevention member is formed from metal or resin. In this manner, by using a material that has appropriate rigidity and is also easily processed, it is possible to easily form the developer affixing prevention member.

Also, a configuration is adopted in which the developer affixing prevention member is disposed in the vicinity of the developer resupply port provided in the development case, but it is also possible to dispose a developer affixing prevention member not in the vicinity of the developer resupply port, but at a plurality of locations along the developer conveying member.

Because the development apparatus has the above sort of configuration, it is possible to, without interfering with size reduction of an apparatus, reliably prevent the occurrence of developer condensation or developer affixing to the developer conveying member with a very simple configuration. Thus, it is possible to achieve longevity of the development apparatus in an image forming apparatus in a high speed processing device.

DESCRIPTION OF THE PREFERRED EMBODIMENTS

Hereinafter, an embodiment of an image forming apparatus equipped with a development apparatus will be described with reference to the attached drawings.

—Description of Overall Image Forming Apparatus—

Figure 1:
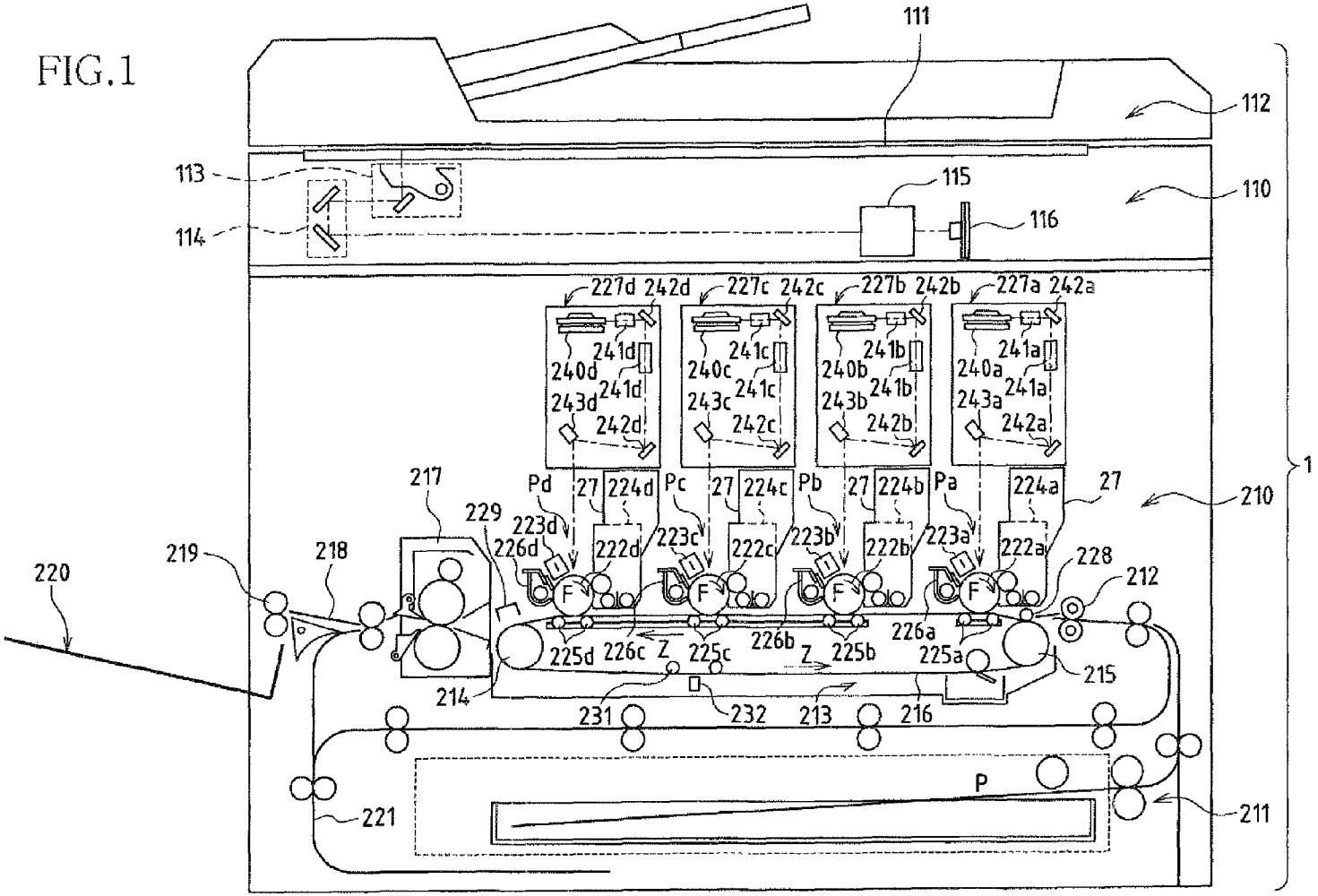
FIG. 1 is a schematic cross-sectional view that shows the configuration of a digital color copier as an image forming apparatus.

FIG. 1 is a schematic cross-sectional view that shows the configuration of a digital color copier (referred to hereinafter as simply a copier) 1 as a color image forming apparatus according to the present embodiment. This copier 1 is provided with a duplex automatic original feeding apparatus (RADF: Reversing Automatic Document Feeder) 112, an image reading portion 110, and an image forming portion 210.

An original stage 111 and an operating panel described below are provided on the upper face of the main body of the copier 1. The duplex automatic original feeding apparatus 112 is supported on the upper face side of the original stage 111 in a state such that the duplex automatic original feeding apparatus 112 can be opened or closed relative to the original stage 111.

The duplex automatic original feeding apparatus 112, first, transports an original such that one face of the original faces the image reading portion 110 at a predetermined position of the original stage 111. Then, after image reading is finished for that one face, the original is turned over and transported toward the original stage 111 such that the other face of the original faces the image reading portion 110 at the predetermined position of the original stage 111. Then, after duplex image reading is finished for one page of the original, the duplex automatic original feeding apparatus 112 discharges this original, and executes a duplex transport operation for the next original. The operation of the above sort of original transport and front/back reversal is controlled in connection with operation of the copier 1 as a whole.

The image reading portion 110 is disposed below the original stage 111 in order to read an image of an original that has been transported onto the original stage 111 by the duplex automatic original feeding apparatus 112. The image reading portion 110 includes original scanning members 113 and 114, that move back and forth along and parallel to the lower face of the original stage 111, an optical lens 115, and a CCD line sensor 116 that is a photoelectric transducer.

The original scanning members 113 and 114 are configured from a first scanning unit 113 and a second scanning unit 114. The first scanning unit 113 includes an exposing lamp that exposes an original image surface to light, and a first mirror that reflects a reflected optical image from the original in a predetermined direction. Also, the first scanning unit 113 is controlled so as to move back and forth in parallel at a predetermined scanning speed, while maintaining a fixed distance relative to the lower face of the original stage 111.

The second scanning unit 114 includes a second mirror and a third mirror that further reflect, in a predetermined direction, the reflected optical image from the original that has been reflected by the first mirror of the first scanning unit 113. The second scanning unit 114 is controlled so as to move back and forth in parallel while maintaining a fixed speed relationship with the first scanning unit 113.

The optical lens 115 reduces the reflected optical image from the original that has been reflected by the third mirror in the second scanning unit 114, and forms the reduced optical image on the CCD line sensor 116. This optical lens 115 is configured from, for example, a plurality of lens groups.

The CCD line sensor 116 photoelectrically converts the formed optical image and outputs the converted image as an electrical signal. The CCD line sensor 116, for example, is configured with a 3-line color CCD that can read a monochrome or a color image, and output line data that has been color-separated into color components of R (red), G (green), and B (blue). Original image information that has been converted to an electrical signal by the CCD line sensor 116 is further forwarded to an image processing portion (not shown), where predetermined image data processing is performed.

Next is a description of the configuration of an image forming portion 210, and the configuration of each portion related to the image forming portion 210.

Below the image forming portion 210, a paper feed mechanism 211 is provided that feeds toward the image forming portion 210, separately page by page, paper (recording medium) P that has been accumulated and stored in a paper tray. Paper P that has been fed separately page by page is transported to the image forming portion 210, with the timing controlled by a pair of registration rollers 212 disposed at the front of the image forming portion 210. Further, paper P on which an image has been formed on one face is again fed to the image forming portion 210 at the timing of image forming of the image forming portion 210.

A transfer/transport belt mechanism 213 is disposed below the image forming portion 210. The transfer/transport belt mechanism 213 is configured to electrostatically attract and transport paper P to a transfer/transport belt 216 stretched across so as to extend approximately parallel between a drive roller 214 and an idler roller 215. Near the bottom side of the transfer/transport belt 216, a pattern image detection unit is provided.

Further, on the downstream side of the transfer/transport belt mechanism 213 in the paper transport path, a fixing apparatus 217 is provided in order to fix onto paper P a toner image that has been transferred onto the paper P. Paper P that has passed by a nip between a pair of fixing rollers in the fixing apparatus 217 is, via a switching gate 218 that switches the transport direction, discharged by a discharge roller 219 onto a discharge tray 220 that is installed to an outer wall of the main body of the copier 1.

The switching gate 218 selectively switches the transport path of paper P after fixing, between a path that discharges paper P to the main body of the copier 1 and a path that again feeds paper P toward the image forming portion 210. Paper P that has been switched to the direction that again transports the paper P toward the image forming portion 210 by the switching gate 218 is again fed toward the image forming portion 210 after the front and back of the paper P have been reversed via a switchback transport path 221.

Above the transfer/transport belt 216 in the image forming portion 210, near the transfer/transport belt 216, a first image forming station Pa, a second image forming station Pb, a third image forming station Pc, and a fourth image forming station Pd are provided lined up in order from the upstream side of the paper transport path. The transfer/transport belt 216 is frictionally driven by the drive roller 214 in the direction indicated by arrow Z in FIG. 1, holds paper P fed via the paper feed mechanism 211 as described above, and transports paper P in order to each image forming station Pa to Pd.

Each image forming station Pa to Pd actually has the same configuration. The image forming stations Pa to Pd include respective photosensitive drums 222*a* to 222*d* that are rotationally driven in the direction of arrow F shown in FIG. 1.

Disposed in order in the rotational direction of the photosensitive drums 222*a* to 222*d*, at the periphery of the photosensitive drums 222*a* to 222*d*, are charging units 223*a* to 223*d* that respectively uniformly charge each of the photosensitive drums 222*a* to 222*d*, development apparatuses 224*a* to 224*d* that respectively develop an electrostatic latent image that has been formed on each of the photosensitive drums 222*a* to 222*d*, transfer discharging units 225*a* to 225*d* that respectively transfer developed toner images on each of the photosensitive drums 222*a* to 222*d* to paper P, and cleaning apparatuses 226*a* to 226*d* that remove toner that remains on each of the photosensitive drums 222*a* to 222*d*.

Also, above each of the photosensitive drums 222*a* to 222*d*, respective laser beam scanning units (exposure apparatuses) 227*a* to 227*d* are provided. Each of the laser beam scanning units 227*a* to 227*d* is configured from, for example, a semiconductor laser element (not shown) that emits a dot beam that has been modulated according to image data, respective polygon mirrors (deflection apparatuses) 240*a* to 240*d* for deflecting a laser beam from the semiconductor laser element in a primary scanning direction, respective fθ lenses 241*a* to 241*d* for forming laser beams deflected by the respective polygon mirrors 240*a* to 240*d* as images on the surface of the respective photosensitive drums 222*a* to 222*d*, and respective mirrors 242*a* to 242*d*.

Pixel signals corresponding to a black component of a color original image are input to the laser beam scanning unit 227*a*, pixel signals corresponding to a cyan component of a color original image are input to the laser beam scanning unit 227*b*, pixel signals corresponding to a magenta component of a color original image are input to the laser beam scanning unit 227*c*, and pixel signals corresponding to a yellow component of a color original image are input to the laser beam scanning unit 227*d*. Thus, an electrostatic latent image that corresponds to color-converted original image information is formed on each of the photosensitive drums 222*a* to 222*d*. Black toner is stored in the development apparatus 224*a*, cyan toner is stored in the development apparatus 224*b*, magenta toner is stored in the development apparatus 224*c*, and yellow toner is stored in the development apparatus 224*d*. The electrostatic latent images on the respective photosensitive drums 222*a* to 222*d* are developed with the toner of these colors. Thus, the color-converted original image information is reproduced by the image forming portion 210 as toner images of each color.

A paper attraction charging unit 228 is provided between the first image forming station Pa and the paper feed mechanism 211. The attraction charging unit 228 charges the surface of the transfer/transport belt 216. With the charging by the attraction charging unit 228, paper P that has been fed from the paper feed mechanism 211 is, in a state reliably attracted onto the transfer/transport belt 216, transported from the first image forming station Pa to the fourth image forming station Pd without becoming offset.

On the other hand, in the area between the fourth image forming station Pd and the fixing apparatus 217, approximately directly above the drive roller 214, a charge removal unit 229 is provided. An alternating electric current is applied to the charge removal unit 229 in order to separate paper P that has been electrostatically attracted to the transfer/transport belt 216 from the transfer/transport belt 216.

In the digital color copier with the above configuration, paper in cut sheet form is used as the paper P. When this paper P is fed out from a paper feed cassette and fed into a guide of a paper feed path of the paper feed mechanism 211, the leading edge portion of the paper P is detected by a sensor (not shown), and is temporarily stopped by the pair of registration rollers 212 based on a detection signal output from this sensor. Matched to the timing of the image forming stations Pa to Pd, the paper P is fed onto the transfer/transport belt 216, which is rotating in the direction of arrow Z in FIG. 1. At this time, a predetermined electrical charge is being applied to the transfer/transport belt 216 by the attraction charging unit 228 as described above, so the paper P is stably transported by electrostatic attractive force while passing by the image forming stations Pa to Pd.

In the respective image forming stations Pa to Pd, the toner images of each color are respectively formed, and transferred so as to be superimposed on each other on the face of paper P electrostatically attracted and transported by the transfer/transport belt 216. When image transfer by the fourth image forming station Pd is completed, the paper P is, in order from the leading edge portion thereof, peeled away from on the transfer/transport belt 216 by the charge removal discharging unit, and guided to the fixing apparatus 217. Finally, paper P on which a toner image has been fixed is discharged onto the discharge tray 220 from a paper discharge opening (not shown).

Note that in the configuration disclosed above, optical writing to each photosensitive drum 222*a* to 222*d* is performed by exposing to light by scanning with a laser beam using the laser beam scanning units 227*a* to 227*d*. On the other hand, a configuration may be adopted in which instead of a laser beam scanning unit, a writing optical system (LED unit) is used that is configured from a light emitting diode array and an imaging lens. An LED head has a smaller size than a laser beam scanning unit, and is extremely quiet due to not having a movable portion. Thus, in an image forming apparatus such as a tandem-type digital color copier that requires a plurality of optical writing units, it is possible to ideally use LED heads.

—Basic Configuration of Development Apparatus—

Figure 2:
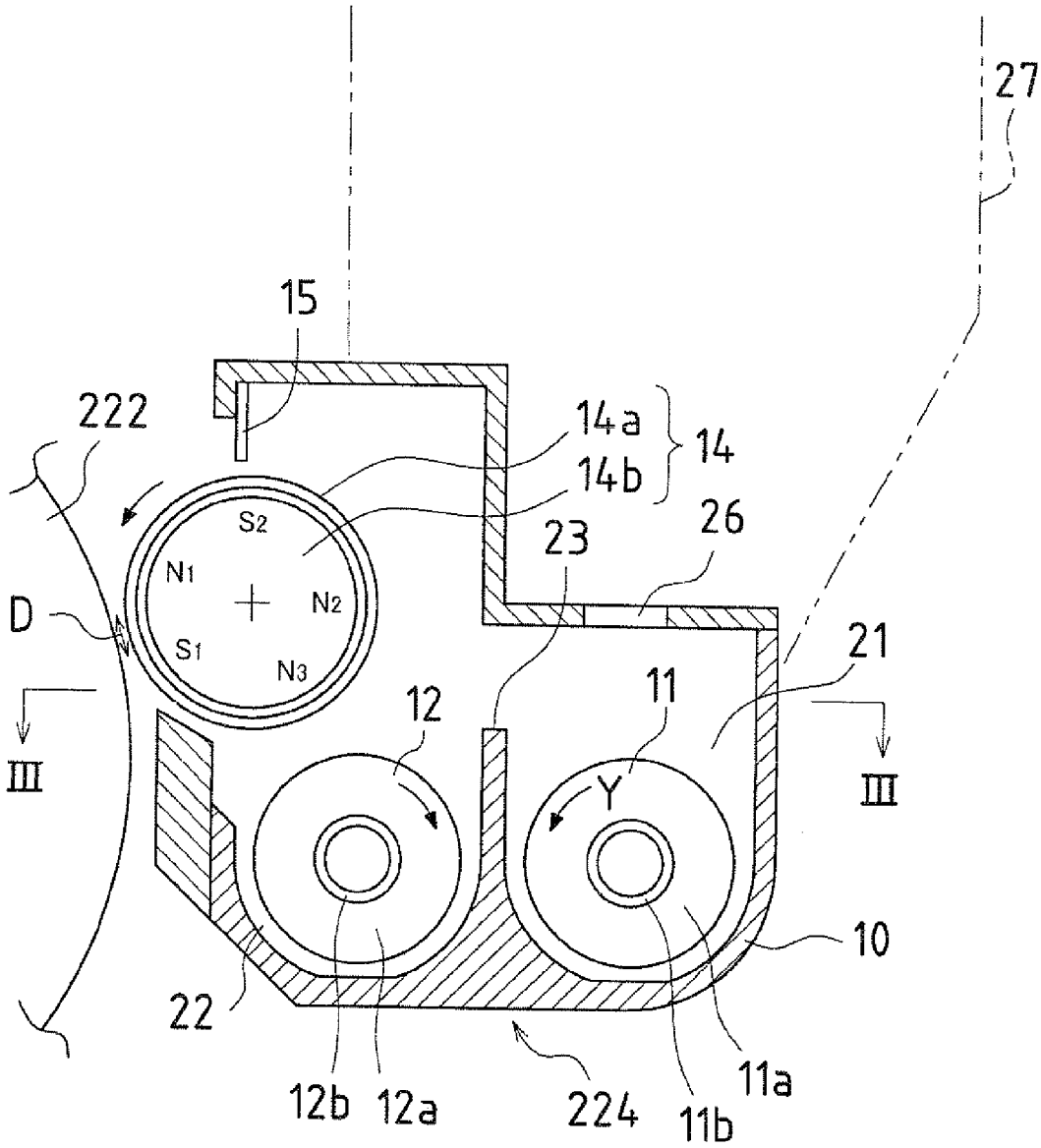
FIG. 2 is a side view that schematically shows a development apparatus.
Figure 3:
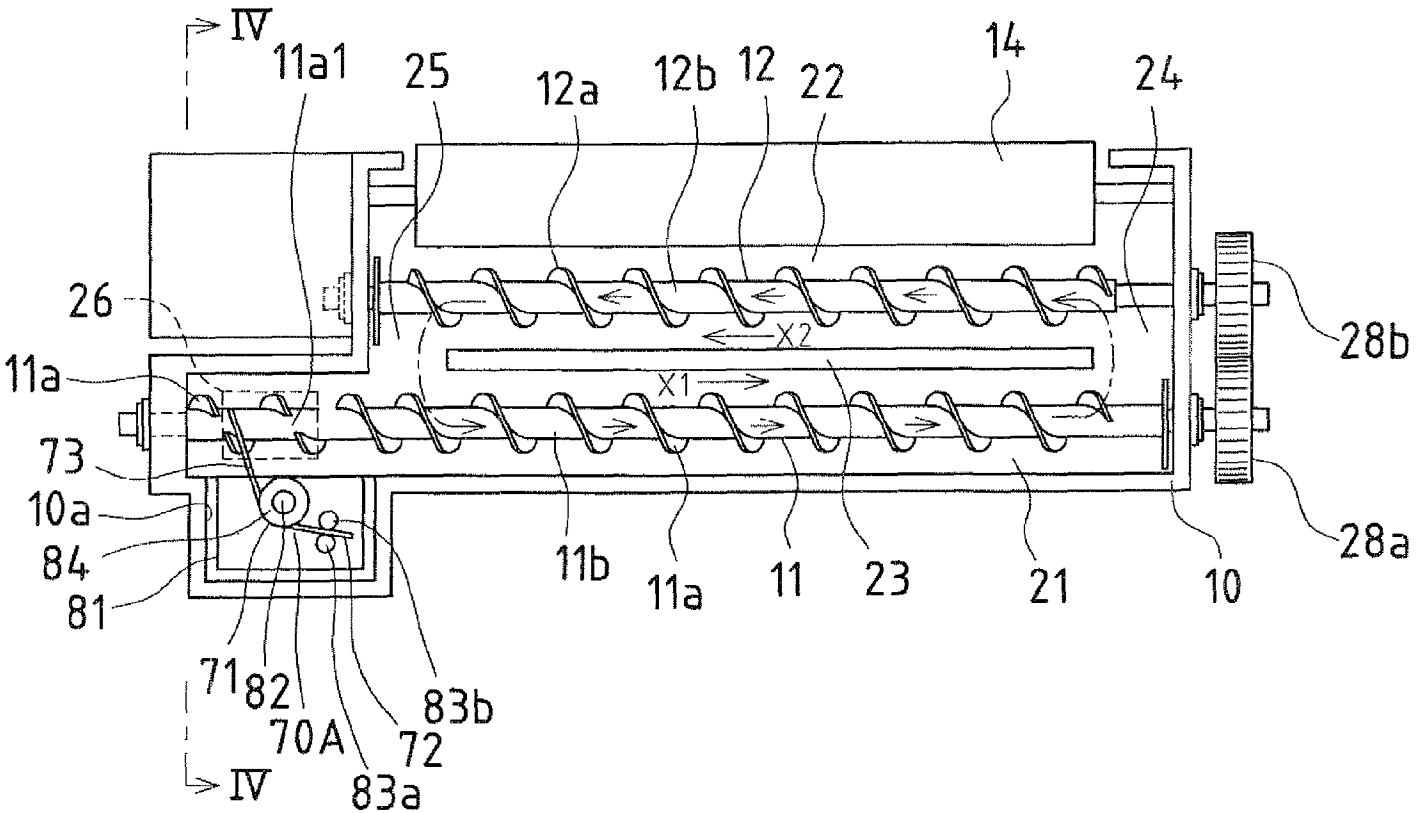
FIG. 3 is a cross-sectional view taken along line III-III in FIG. 2.

FIG. 2 is a side view that schematically shows the development apparatuses 224*a* to 224*d*. FIG. 3 is a cross-sectional view taken along line III-III in FIG. 2. The configuration of each development apparatus 224*a* to 224*d* is the same, so here they will be described using reference numeral 224, without distinguishing between each development apparatus. Also, the photosensitive drums 222*a* to 222*d* that face the development apparatuses 224*a* to 224*d* will be described using reference numeral 222, without distinguishing between each photosensitive drum.

In each development apparatus 224, two-component developer in which magnetic carrier and toner are mixed is stored in a development case (referred to below as simply a 'case') 10, toner in the developer is supplied to each photosensitive drum 222 of the copier 1, an electrostatic latent image on the surface of the photosensitive drum 222 is developed, and thus a toner image is formed on the surface of the photosensitive drum 222.

In the development apparatus 224, a first screw conveyor 11 and a second screw conveyor 12 disposed at the bottom of the case 10 are rotated, thus churning developer, the magnetic carrier and the toner are frictionally charged by this churning, and so an electrical charge is given to the magnetic carrier and the toner.

In a development roller 14, a pole-shaped multipolar-magnetized magnet 14*b* is fixed, and a cylindrical sleeve 14*a* configured from a non-magnetized body (such as an aluminum alloy or stainless steel) around the multipolar-magnetized magnet 14*b* is rotatably supported. While rotating the sleeve 14*a*, developer is attracted to and borne on the outer circumference of the sleeve 14*a* by the magnetic force of the magnet 14*b*.

Along with rotation of the sleeve 14*a*, after the layer thickness of developer on the outer circumference of the sleeve 14*a* is regulated by a layer thickness regulating member 15, the developer layer on the outer circumference of the sleeve 14*a* is transported to a development area D between the sleeve 14*a* and the photosensitive drum 222.

The toner of the developer layer on the outer circumference of the sleeve 14*a* is frictionally charged with a polarity opposite to the polarity of the electrostatic latent image on the surface of the photosensitive drum 222 by churning of the first screw conveyor 11 and the second screw conveyor 12. Thus, when the developer layer on the outer circumference of the sleeve 14*a* has reached the development area D between the sleeve 14*a* and the photosensitive drum 222, the electrostatic latent image becomes a toner image due to the toner of the developer layer affixing to the electrostatic latent image on the surface of the photosensitive drum 222.

On the other hand, in the bottom portion of the case 10 of the development apparatus 224, a first developer conveying path 21 one end of which faces a toner resupply port 26 formed in a lid portion of the case 10, and a second developer conveying path 22, are provided in rows, and the developer conveying paths 21 and 22 are partitioned by a partition wall 23. Between both ends of the partition wall 23 and the case 10, respective open portions 24 and 25 are provided, and thus the developer conveying paths 21 and 22 have a structure so as to be in communication with each other via the open portions 24 and 25.

The above-mentioned first screw conveyor 11 is disposed in the first developer conveying path 21, and the above-mentioned second screw conveyor 12 is disposed in the second developer conveying path 22. Further, a drive gear 28*a* fixed to a rotating shaft 11*b* of the first screw conveyor 11, and a drive gear 28*b* fixed to a rotating shaft 12*b* of the second screw conveyor 12, are engaged outside of the case 10. Also, the development roller 14 is disposed parallel to the second screw conveyor 12 in the vicinity of the second developer conveying path 22.

Spirally-formed fins 11*a* and 12*a* that respectively rotate in the same direction are formed on the rotating shaft 11*b* of the first screw conveyor 11 and the rotating shaft 12*b* of the second screw conveyor 12, and with rotation of these fins 11*a* and 12*a* (virtual spiral rotation), the developer is conveyed. In this case, the first screw conveyor 11 and the second screw conveyor 12 rotate in reverse due to engagement of the drive gears 28*a* and 28*b*, and with such a difference in rotational direction, a conveying direction X1 of developer due to rotation of the first screw conveyor 11, and a conveying direction X2 due to rotation of the second screw conveyor 12, are directions opposite to each other.

More specifically, toner that has been resupplied from the toner resupply port 26 is conveyed in the first developer conveying path 21 by the first screw conveyor 11 while mixing with magnetic carrier in the rightward direction in FIG. 3 (conveying direction X1), developer in which toner and the magnetic carrier have been mixed is conveyed to the second developer conveying path 22 via the open portion 24 on the right end, then conveyed in the second developer conveying path 22 by the second screw conveyor 12 in the leftward direction in FIG. 3 (conveying direction X2), and again conveyed to the first developer conveying path 21 via the open portion 25 on the left end. The developer is circulated by following this sort of conveying path.

The developer, during circulating conveying, affixes to the outer circumferential face of the development roller 14 disposed near the second developer conveying path 22, is transported to the development area D between the development roller 14 and the photosensitive drum 222, and the electrostatic latent image on the photosensitive drum 222 is developed by that transported toner.

Also, when as a result of repeating such electrostatic latent image development, the toner in the developer is consumed, and so the toner concentration of the developer has decreased, toner is resupplied into the case 10 via the toner resupply port 26 from a toner cartridge 27. This toner is mixed into the circulating developer inside the first developer conveying path 21. Thus, the toner concentration of the developer is returned to its original state.

Here, the toner that has been resupplied from the toner resupply port 26 to the first developer conveying path 21 merges with the developer that has been conveyed from the second developer conveying path 22 via the open portion 25 immediately behind the position of that toner resupply port 26, and this merging portion is in a location where accumulation easily occurs. Therefore, particularly in the vicinity of the toner resupply port 26 on the front side of the merging portion, toner easily accumulates, and as a result, toner easily condenses on the end portion (in the vicinity facing the toner resupply port 26) of the first screw conveyor 11.

Consequently, as shown in FIG. 3, a configuration is adopted in which a developer affixing prevention member 70 that prevents affixing of developer is provided in the first screw conveyor 11 in the vicinity of the toner resupply port 26. Following is a specific description of the configuration of this developer affixing prevention member 70.

—Configuration of Developer Affixing Prevention Member—

Figure 4:
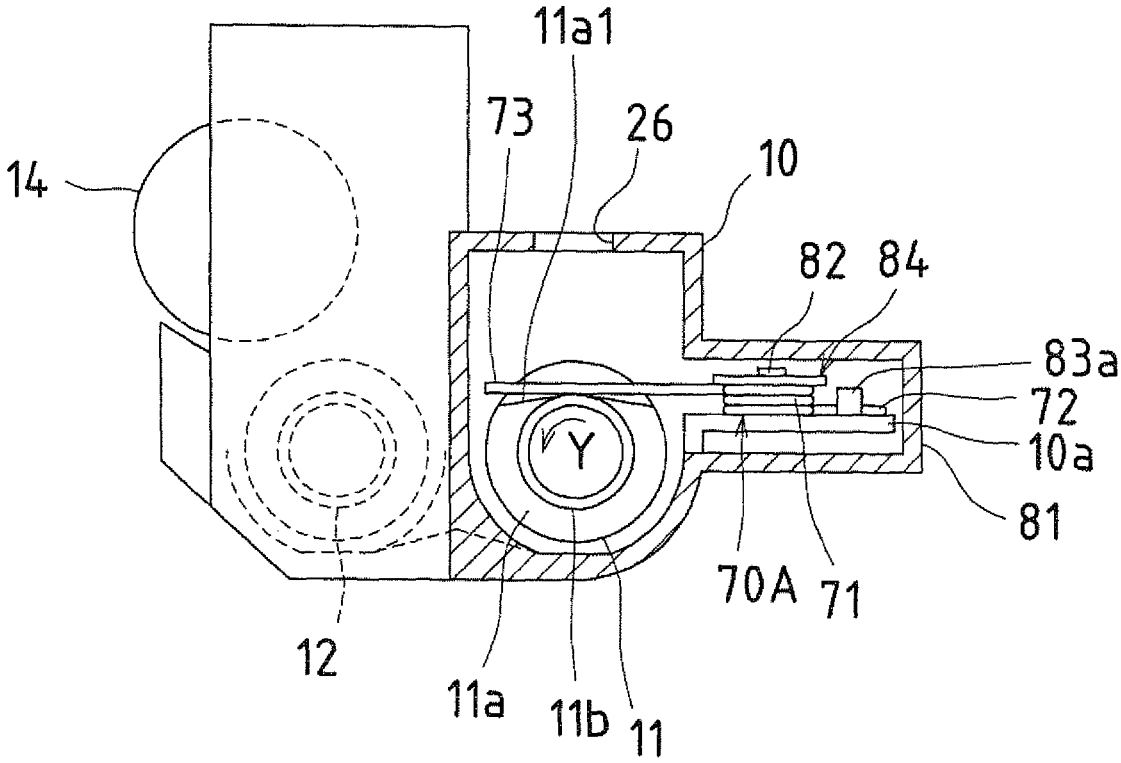
FIG. 4 is a cross-sectional view taken along line IV-IV in FIG. 3.
Figure 5A:
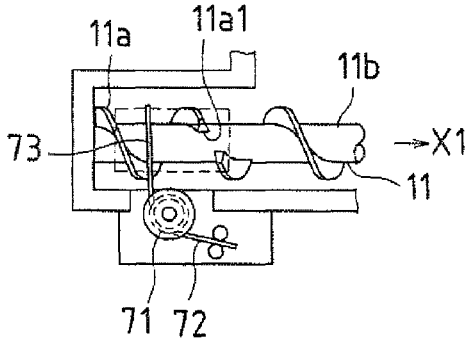
FIGS. 5(*a*) to 5(*e*) are explanatory diagrams that show a course of operation of a torsion coil spring that is Embodiment 1 of a developer affixing prevention member.
Figure 5B:
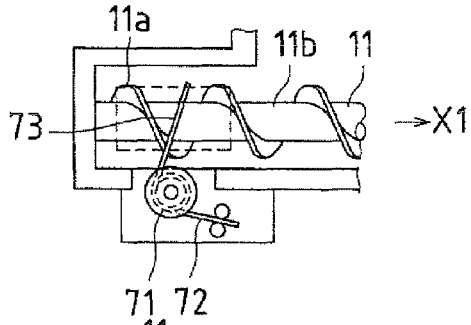
Figure 5C:
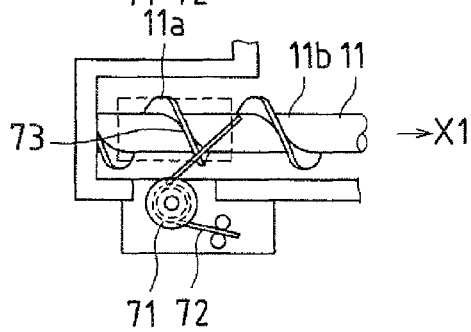
Figure 5D:
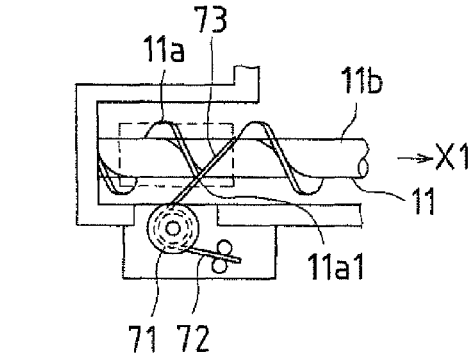
Figure 5E:
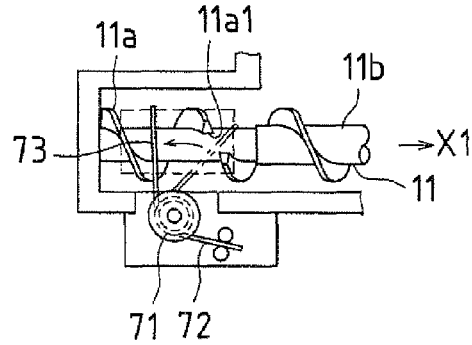

FIG. 4 is a cross-sectional view taken along line IV-IV in FIG. 3, and FIGS. 5(*a*) to 5(*e*) are plan views that show an enlargement of a portion of the developer affixing prevention member 70 shown in FIG. 3. Following is a description of an embodiment (Embodiment 1) of the developer affixing prevention member 70, with reference to FIGS. 3 to 5(*e*).

In Embodiment 1, as shown in FIG. 3, a housing portion 10*a* that houses the developer affixing prevention member 70 is formed in the case 10 on the left end side of the first screw conveyor 11, and in this housing portion 10*a*, a support plate 81 is provided in order to support and fix the developer affixing prevention member 70. This support plate 81 is provided extended horizontally from the outside face of the case 10, and on the upper face side thereof, a cylindrical supporting/protruding portion 82 is formed in order to support the developer affixing prevention member 70.

On the other hand, in Embodiment 1, the developer affixing prevention member 70 is formed with a torsion coil spring 70A formed from the wire rod whose middle is wound in a coil-like shape. As the material that forms the torsion coil spring 70A, it is possible to use, for example, a non-magnetic material such as stainless steel, phosphor bronze, beryllium copper, or aluminum.

By fitting a winding portion 71 of the torsion coil spring 70A together with the supporting/protruding portion 82 of the support plate 81 from above, and mounting a retaining member 84 in the upper portion of the supporting/protruding portion 82, the torsion coil spring 70A is installed so as to not be removed from the support plate 81. In a state installed to the support plate 81 in this manner, one arm portion 72 of the torsion coil spring 70A is fixed to the support plate 81, and another arm portion 73 is extended so as to contact the fin 11*a* and the rotating shaft 11*b* of the first screw conveyor 11. Fixing of the one arm portion 72 may be performed with the arm portion 72 sandwiched between a pair of small protrusions 83*a* and 83*b* formed in the support plate 81. However, the technology is not limited to such a fixing structure.

In this sort of structure, the torsion coil spring 70A is disposed approximately horizontally as shown in FIG. 4, and the other arm portion 73 that is the free end is movable back and forth in this horizontal plane and in the direction of the shaft core of the first screw conveyor 11 (direction perpendicular to the paper face in FIG. 4).

On the other hand, a cut-out portion 11*a*1 of a predetermined width is formed in a portion of the fin 11*a* of the first screw conveyor 11 at a position that faces the torsion coil spring 70A disposed in this manner. That is, the position where the cut-out portion 11*a*1 is formed is slightly on the downstream side in the conveying direction X1 (the right side in FIG. 4) from the supporting/protruding portion 82 that is the center of rotation of the torsion coil spring 70A. This formation position changes slightly depending on how much the torsion coil spring 70A is elastically deformed when the torsion coil spring 70A is returned to its original shape. Note that as shown in FIG. 4, the cut-out portion 11*a*1 is formed such that the depth of the cut-out portion 11*a*1 reaches the rotating shaft 11*b*.

Next is a description of the operation and action of the torsion coil spring 70A with the above sort of shape and structure, with reference to FIGS. 5(*a*) to 5(*e*).

In the initial state, as shown in FIG. 5(*a*), the arm portions 72 and 73 of the torsion coil spring 70A are disposed in a most widely spread state, and the arm portion 73 that is the free end is pressed against (in contact with) the fin 11*a* and the rotating shaft 11*b* of the first screw conveyor 11 by biasing force such that the winding portion 71 attempts to spread. Also, the cut-out portion 11*a*1 is positioned approximately one rotation ahead of the position of the fin 11*a* where the arm portion 73 is in contact. In the state shown in FIG. 5(*a*), when the first screw conveyor 11 rotates in the leftward direction (counterclockwise direction) Y in FIG. 4, the arm portion 73 of the torsion coil spring 70A, due to rotation (virtual spiral rotation) of the fin 11*a* with rotation of the first screw conveyor 11, in a state in contact with the circumferential end portion of the fin 11*a*, is pressed into the fin 11*a*, and moves so as to be pushed to the downstream side in the conveying direction X1. That is, the arm portion 73 moves so as to wind up the winding portion 71. This course of being pressed in is shown in FIGS. 5(*b*) and 5(*c*).

At this time, the middle of the arm portion 73 contacts the rotating shaft 11*b* of the first screw conveyor 11, and moves along the surface of the rotating shaft 11*b*, and thus acts so as to scrape away developer that is affixed to the surface of the rotating shaft 11*b*. Also, the arm portion 73 moves so as to largely depict an arc toward the downstream side of the conveying direction X1, and thus acts so as to cut and unstiffen developer.

Also, as shown in FIG. 5(*d*), when the fin 11*a* makes approximately one rotation, and the cut-out portion 11*a*1 returns near its original position, the arm portion 73 that was in contact with the outer circumferential end portion of the fin 11*a* is fitted into the cut-out portion 11*a*1, and thus is in a state just before separating from the fin 11*a*. At this time, the arm portion 73 is in the most pressed and bent state, and is in a state in which significant winding force has been accumulated in the winding portion 71.

When the fin 11*a* further rotates from this state, as shown in FIG. 5(*e*), engagement of the arm portion 73 and the fin 11*a* is released, and at that instant, the arm portion 73 is instantly restored to its original shape by an elastic counter force due to the winding force accumulated in the winding portion 71. That is, the arm portion 73 instantly moves to the upstream side in the conveying direction X1, and again makes contact with the fin 11*a* on the upstream side. In FIG. 5(*e*), a state immediately before the arm portion 73 separates from the fin 11*a* is indicated by a broken line, and a state in which the arm portion 73 has been elastically restored is indicated by a solid line.

Due to the instant movement of the arm portion 73 at this time to the upstream side in the conveying direction X1, the arm portion 73 acts such that the developer in that vicinity is flicked away, i.e. such that the developer is broken up (churned). Thus, even if toner condensation begins, it is possible to instantly break up that toner condensation, and as a result it is possible to reliably prevent progression to toner affixing. The torsion coil spring 70A, while the first screw conveyor 11 is rotating, repeats the above operation (the operation shown from FIG. 5(*a*) to FIG. 5(*e*)) each time the first screw conveyor 11 makes one rotation.

Note that in above Embodiment 1, due to the arm portion 73 passing by the cut-out portion 11*a*1, the arm portion 73 is instantly restored to its original shape, but the cut-out portion 11*a*1 is not absolutely necessary. Even when there is no cut-out portion 11*a*1, due to the tip portion of the arm portion 73 traveling over the outer circumferential end portion of the fin 11*a*, instant movement of the arm portion 73 to the upstream side in the conveying direction X1 is possible. However, in this case, immediately before the arm portion 73 travels over the outer circumferential end portion of the fin 11*a*, the arm portion 73 and the rotating shaft 11*b* of the first screw conveyor 11 are temporarily separated, so in consideration of stability of operation, it is preferable that the cut-out portion 11*a*1 is provided.

Here, it is desirable that the diameter of the torsion coil spring 70A is 0.1 to 2.0 mm. The reason for this is that when the diameter of the torsion coil spring 70A is less than 0.1 mm, there is a risk that it will not be possible to adequately prevent toner condensation, and when greater than 2.0 mm, there is a risk that the fin 11*a* will be damaged. Here ends the description of the operation and action of the torsion coil spring 70A.

Figure 6A:
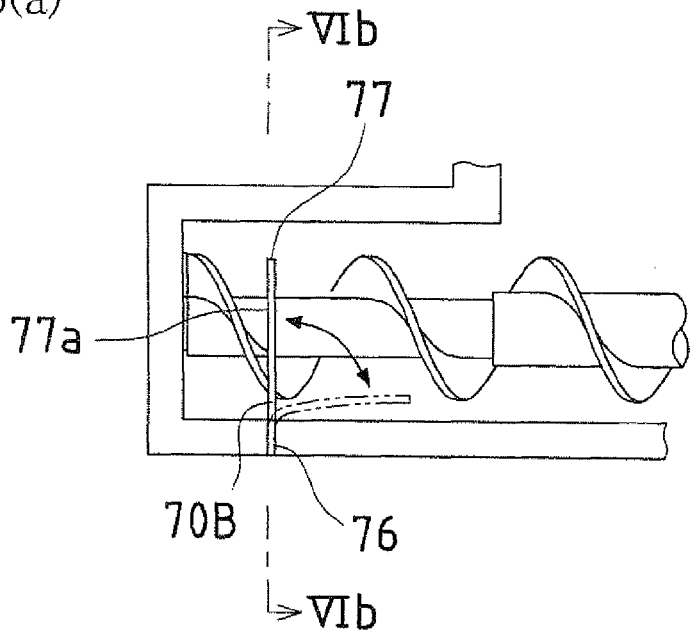
FIGS. 6(*a*) and 6(*b*) show a plate spring that is Embodiment 2 of the developer affixing prevention member, with FIG. 6(*a*) being a plan view and FIG. 6(*b*) being a cross-sectional view taken along line VIb-VIb in FIG. 6(*a*).
Figure 6B:
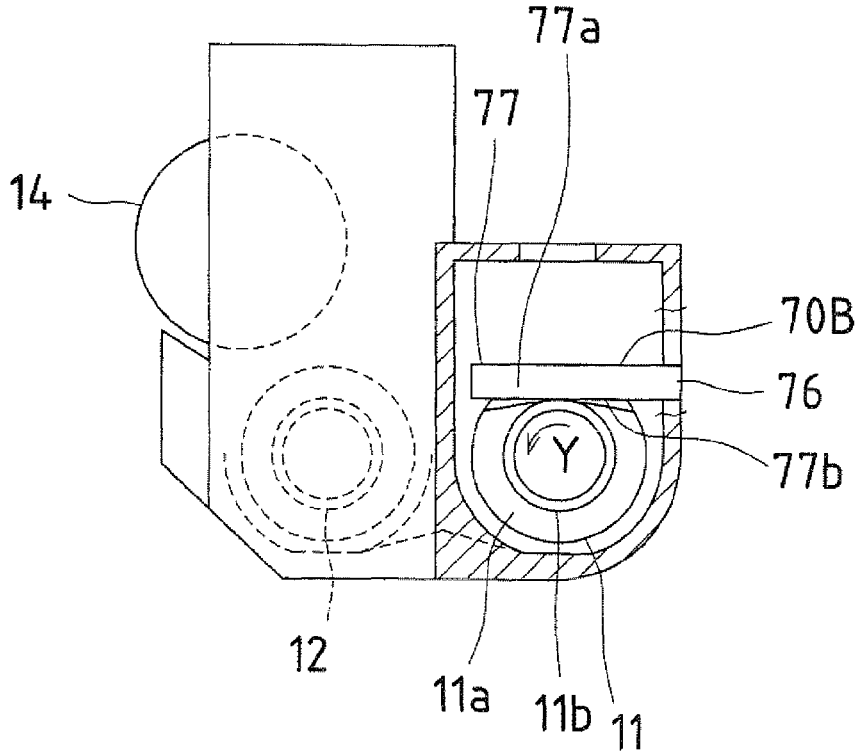
Figure 7A:
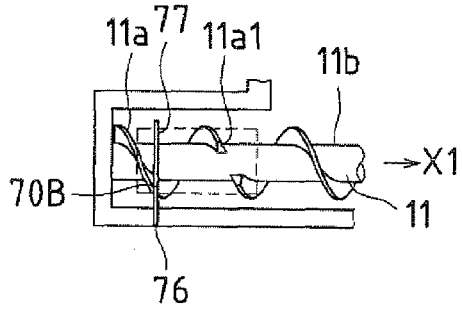
FIGS. 7(*a*) to 7(*e*) are explanatory diagrams that show a course of operation of the plate spring that is Embodiment 2 of the developer affixing prevention member.
Figure 7B:
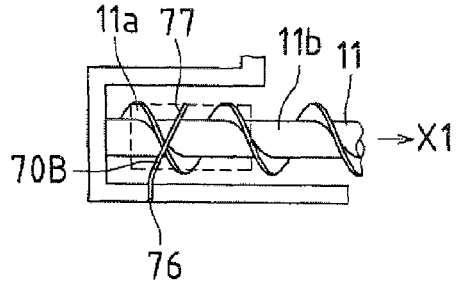
Figure 7C:
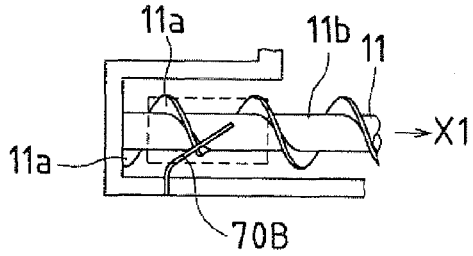
Figure 7D:
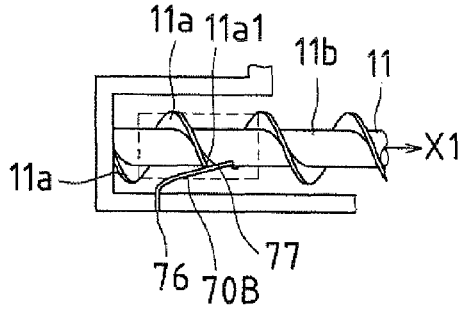
Figure 7E:
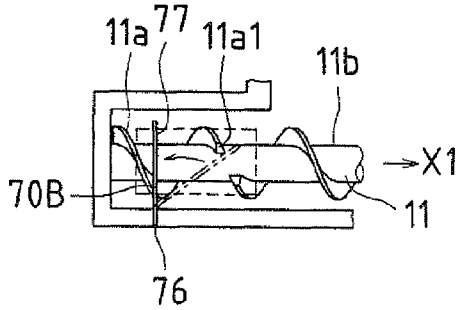
Figure 8:
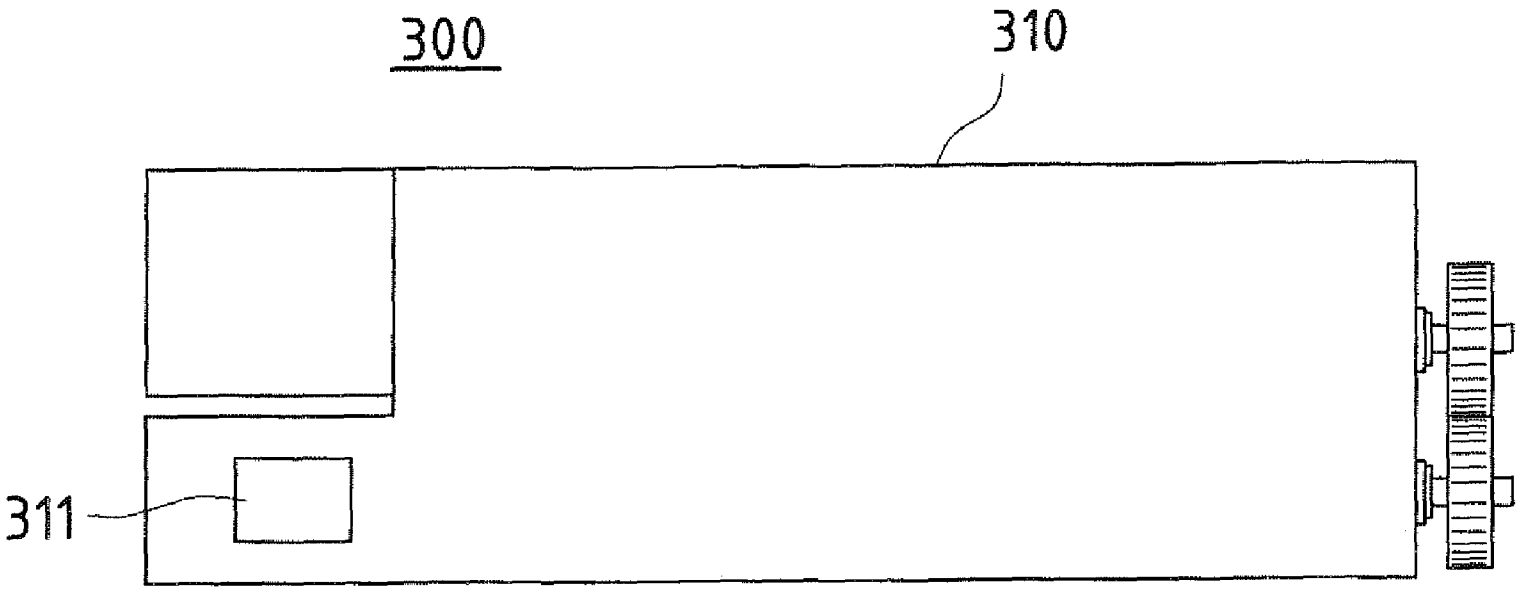
FIG.8 Conventional Art
FIG. 8 is a plan view showing a state in which an upper lid has been provided in a conventional development apparatus.
Figure 9:
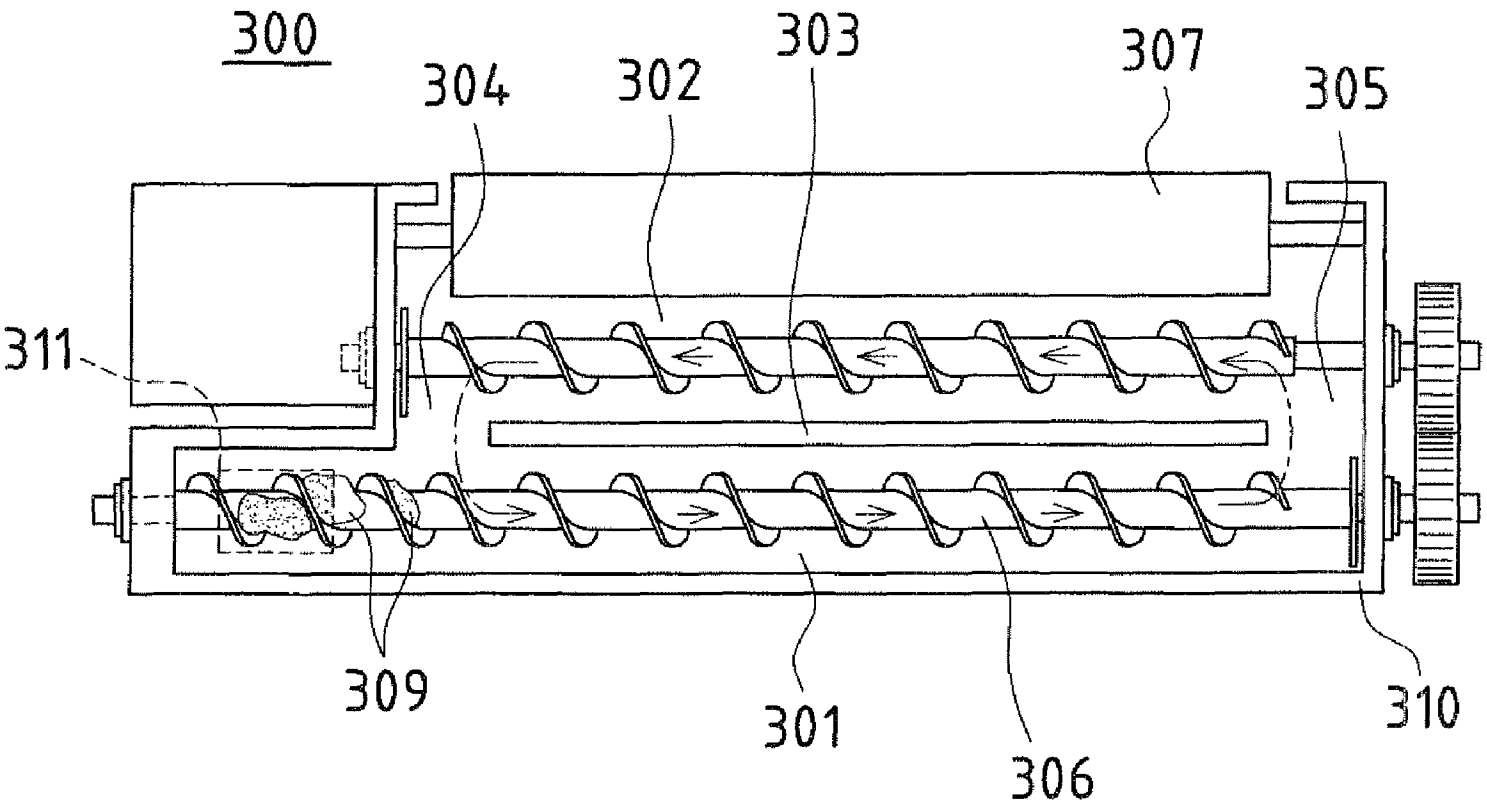
FIG.9 Conventional Art
FIG. 9 is a plan view showing a state in which the upper lid is omitted in the conventional development apparatus.

FIGS. 6(*a*) and 6(*b*) show another embodiment (Embodiment 2) of the developer affixing prevention member 70, with FIG. 6(*a*) being a plan view and FIG. 6(*b*) being a cross-sectional view taken along line VIb-VIb in FIG. 6(*a*).

In Embodiment 2, the developer affixing prevention member 70 is formed with a plate spring 70B having strip form. A base end portion 76 of the plate spring 70B is fixed to the inside face of the case 10, a back face 77*a* of a tip end portion 77 side contacts the fin 11*a* of the first screw conveyor 11, and a lower side edge 77*b* of the tip end portion 77 side is disposed so as to contact the rotating shaft 11*b*. As the material that forms this sort of plate spring 70B, it is possible to use, for example, a non-magnetic material such as stainless steel, phosphor bronze, beryllium copper, aluminum, Carbon Fiber Reinforced Plastic (CFRP), Glass Fiber Reinforced Plastic (GFRP), or Aramid Fiber Reinforced Plastic (AFRP). Also, same as in above Embodiment 1, the cut-out portion 11*a*1 is formed in the fin 11*a* approximately one rotation ahead of the position of the fin 11*a* where the plate spring 70B is in contact.

In this sort of structure, the plate spring 70B is disposed approximately horizontally as shown in FIG. 6(*b*), and the tip end portion 77 side that is the free end can operate in a curve in this horizontal plane and in the direction of the shaft core of the first screw conveyor 11. Next is a description of the operation and action of the plate spring 70B with the above sort of shape and structure, with reference to FIGS. 7(*a*) to 7(*e*).

In the initial state, as shown in FIG. 7(*a*), the plate spring 70B is in a state extended approximately straight towards the rotating shaft 11*b*, and in contact with the fin 11*a* and the rotating shaft 11*b* of the first screw conveyor 11. Also, the cut-out portion 11*a*1 is positioned approximately one rotation ahead of the position of the fin 11*a* where the plate spring 70B is in contact. In the state shown in FIG. 7(*a*), when the first screw conveyor 11 rotates in the leftward direction Y in FIG. 4, the plate spring 70B, due to rotation (virtual spiral rotation) of the fin with rotation of the first screw conveyor 11, in a state in contact with the outer circumferential end portion of the fin 11*a*, is pressed into the fin 11*a*, and moves so as to be pushed to the downstream side in the conveying direction X1. This course of being pressed in is shown in FIGS. 7(*b*) and 7(*c*).

At this time, the middle of the side edge 77*b* of the plate spring 70B contacts the rotating shaft 11*b* of the first screw conveyor 11, and moves along the surface of the rotating shaft 11*b*, and thus acts so as to scrape away developer that is affixed to the surface of the rotating shaft 11*b*. Also, the plate spring 70B moves so as to largely depict an arc toward the downstream side of the conveying direction X1, and thus acts so as to agitate and unstiffen developer.

Also, as shown in FIG. 7(*d*), when the fin 11*a* makes approximately one rotation, and the cut-out portion 11*a*1 returns near its original position, the tip end portion 77 side of the plate spring 70B that was in contact with the outer circumferential end portion of the fin 11*a* is fitted into the cut-out portion 11*a*1, and thus is in a state just before separating from the fin 11*a*. At this time, the plate spring 70B is in the most pressed and bent state, and is in a state in which significant elastic counter force has been accumulated.

When the fin 11*a* further rotates from this state, as shown in FIG. 7(*e*), engagement of the tip end portion 77 side of the plate spring 70B and the fin 11*a* is released, and at that instant, the plate spring 70B is instantly restored to its original shape due to the accumulated elastic counter force. That is, the bent tip end portion 77 side instantly moves to the upstream side in the conveying direction X1, and again makes contact with the fin 11*a* on the upstream side. In FIG. 7(*e*), a state immediately before the plate spring 70B separates from the fin 11*a* is indicated by a broken line, and a state in which the plate spring 70B has been elastically restored is indicated by a solid line.

Due to the instant movement of the plate spring 70B at this time to the upstream side in the conveying direction X1, the plate spring 70B acts such that the developer in that vicinity is flicked away, i.e. such that developer is broken up (churned). Thus, even if toner condensation begins, it is possible to instantly break up that toner condensation, and as a result it is possible to reliably prevent progression to toner affixing. The plate spring 70B, while the first screw conveyor 11 is rotating, repeats the above operation (the operation shown from FIG. 7(*a*) to FIG. 7(*e*)) each time the first screw conveyor 11 makes one rotation.

Note that in above Embodiment 2, due to the tip end portion 77 side of the plate spring 70B passing by the cut-out portion 11*a*1, the tip end portion 77 side is instantly restored to its original shape, but the cut-out portion 11*a*1 is not absolutely necessary. Even when there is no cut-out portion 11*a*1, due to the tip end portion 77 of the plate spring 70B traveling over the outer circumferential end portion of the fin 11*a*, instant movement of the tip end portion 77 to the upstream side in the conveying direction X1 is possible. However, in this case, immediately before the tip end portion 77 travels over the outer circumferential end portion of the fin 11*a*, the side edge 77*b* of the plate spring 70B and the rotating shaft 11*b* of the first screw conveyor 11 are temporarily separated, so in consideration of stability of operation, it is preferable that the cut-out portion 11*a*1 is provided.

Note that in the above embodiments, a configuration was described in which the developer affixing prevention member 70 is provided in the first developer conveying path 21 in the vicinity of the toner resupply port 26, but the developer affixing prevention member 70 may also be provided in another location of the first developer conveying path 21 and the second developer conveying path 22 where heat occurs due to developer conveying and toner easily condenses, or may be provided in a plurality of locations.

Also, in the above embodiments, a situation was described in which a development apparatus was applied in an image forming apparatus that employs a two-component developer constituting a magnetic carrier and a toner, but a development apparatus is also applicable to an image forming apparatus that employs a one-component developer constituting only a toner. That is, also in an image forming apparatus that employs a one-component developer, same as in the above embodiments, developer may be conveyed by a developer conveying member, and the developer affixing prevention member 70 can be provided such that toner does not condense and affix to the developer conveying member.

The technology may be embodied in various other forms without departing from the gist or essential characteristics thereof. The embodiments disclosed in this application are to be considered in all respects as illustrative and not limiting. The scope of the invention is indicated by the appended claims rather than by the foregoing description, and all modifications or changes that come within the meaning and range of equivalency of the claims are intended to be embraced therein.

What is claimed is:

1. A development apparatus comprising, inside a development case:

a developer bearing member that supplies developer including at least toner to a latent image bearing member;

a developer conveying member that conveys the developer towards the developer bearing member, wherein the developer conveying member comprises a rotating shaft and a fin spirally formed on an outer circumferential portion of the rotating shaft; and a developer affixing prevention member that prevents the developer from affixing to the developer conveying member, wherein the developer affixing prevention member comprises an elastic member having a fixed end and a free end, and wherein the free end of the developer affixing prevention member is disposed so as to contact the fin or contact the fin and the rotating shaft;

wherein a cut-out portion is formed in a portion of the fin of the developer conveying member faced by the free end of the developer affixing prevention member, and wherein the free end of the developer affixing prevention member that has been elastically deformed with rotation of the fin due to rotation of the developer conveying member is elastically returned via the cut-out portion.

2. The development apparatus according to claim 1, wherein the developer affixing prevention member is disposed in the vicinity of a toner resupply port provided in the development case in order to resupply toner stored in a toner storage container into the development case.

3. The development apparatus according to claim 1, wherein the developer affixing prevention member is formed with a torsion coil spring formed from a wire rod whose middle is wound in a coil-like shape, and in a state with the winding portion of the torsion coil spring supported by the development case, one end is fixed to the development case, and the other end is the free end.

4. The development apparatus according to claim 1, wherein the developer affixing prevention member is formed with a plate spring having strip form, and one end of the plate spring is fixed to the development case and the other end is the free end.

5. The development apparatus according to claim 1, wherein the developer affixing prevention member is formed from a non-magnetic member.

6. The development apparatus according to claim 5, wherein the developer affixing prevention member is formed from metal or resin.

7. An image forming apparatus comprising:

a development apparatus according to claim 1.

8. A development apparatus comprising, inside a development case:

a developer bearing member that supplies developer including at least toner to a latent image bearing member;

a developer conveying member that conveys the developer towards the developer bearing member, wherein the developer conveying member comprises a rotating shaft and a fin spirally formed on an outer circumferential portion of the rotating shaft; and a developer affixing prevention member that prevents the developer from affixing to the developer conveying member, wherein the developer affixing prevention member comprises a torsion coil spring formed from a wire rod whose middle is wound in a coil-like shape, wherein a winding portion of the torsion coil spring is supported by the development case, one end of the coil spring is fixed to the development case, and the other end of the coil spring comprises a free end, and wherein the free end of the coil spring is disposed so as to contact the fin or contact the fin and the rotating shaft.

9. The development apparatus according to claim 8, wherein the developer affixing prevention member is disposed in the vicinity of a toner resupply port provided in the development case in order to resupply toner stored in a toner storage container into the development case.

10. The development apparatus according to claim 8, wherein the developer affixing prevention member is formed from a non-magnetic member.

11. The development apparatus according to claim 10, wherein the developer affixing prevention member is formed from metal or resin.

12. An image forming apparatus comprising a development apparatus according to claim 8.

* * * * *